United States Patent [19]

Dunn

[11] Patent Number: 4,858,408

[45] Date of Patent: Aug. 22, 1989

[54] HOLD DOWN CLIP

[75] Inventor: James J. Dunn, St. Charles, Ill.

[73] Assignee: Chicago Metallic Corporation, Chicago, Ill.

[21] Appl. No.: 146,094

[22] Filed: Jan. 20, 1988

[51] Int. Cl.[4] ..... E04B 5/52

[52] U.S. Cl. ..... 52/489; 24/562

[58] Field of Search ..... 52/489, 712; 439/95, 439/387; 24/562, 561, 555, 563, 547, 556; 248/316.1, 62, 74.1, 72; 223/91

[56] References Cited

U.S. PATENT DOCUMENTS

| | | | |
|---|---|---|---|
| 2,724,960 | 11/1955 | Nelsson | 72/118 |
| 2,891,296 | 6/1959 | Darde | 248/74.1 X |
| 3,216,537 | 11/1965 | Nelsson | 189/35 |
| 3,232,021 | 2/1966 | Wilson | 52/507 |
| 3,248,839 | 5/1966 | Roberts | 52/484 |
| 3,298,646 | 1/1967 | Van Buren, Jr. | 248/72 |
| 3,565,473 | 2/1971 | Kedel | 52/714 |
| 3,594,682 | 7/1971 | Oleson | 439/387 X |
| 3,703,794 | 11/1972 | Gracon et al. | 52/506 |
| 3,730,466 | 5/1973 | Swanquist | 248/216 |
| 3,784,144 | 1/1974 | Ollinger et al. | 248/317 |
| 3,809,358 | 5/1974 | Hazeley | 248/317 |
| 4,027,454 | 6/1977 | Schuplin | 52/714 |
| 4,251,844 | 2/1981 | Horstman | 248/74.1 |
| 4,408,428 | 10/1983 | Brooke et al. | 52/489 |
| 4,479,341 | 10/1984 | Schuplin | 52/665 |
| 4,545,166 | 10/1985 | Kielmeyer | 52/484 |
| 4,580,387 | 4/1986 | Rogers | 52/665 |

*Primary Examiner*—Carl D. Friedman

*Attorney, Agent, or Firm*—Hill, Van Santen, Steadman & Simpson

[57] ABSTRACT

A hold-down clip for holding panels on inverted T-shaped members in a suspended ceiling characterized by a U-shaped one-piece member having a bight portion interconnecting two leg portions. Each of the leg portions, along an edge, has an inwardly bent flange with a plurality of teeth aligned with the teeth in the opposite leg portion and each of the leg portions has a foot portion adjacent the free end for engaging and holding the panel on the flanges of the T-shaped member. To increase the rigidity of the bight portion, it is preferably provided with two spaced embossments that extend into adjacent portions of each of the leg portions.

19 Claims, 1 Drawing Sheet

HOLD DOWN CLIP

BACKGROUND OF THE INVENTION

The present invention is directed to a hold-down clip for holding panels of a suspended ceiling system characterized by the clip having a U-shaped configuration with a bight portion which interconnects two legs having teeth and each of the legs has a foot portion for engaging the panel and holding it on flanges of inverted T-members or runners.

Hold-down clips for holding panels or tiles in a suspended ceiling system are known. U.S. Pat. No. 3,565,473 discloses a hold-down clip which is stamped out of a sheet metal and has a planar, U-shaped configuration with each of the legs having inwardly directed teeth for engaging a bead of a runner while the legs each terminate in feet for engaging the top surface of a panel to hold it on a flange of the runner. However, because of the resilient nature of the interconnecting portion, the sheet metal clip can twist on the runner, which has proven unsatisfactory.

U.S. Pat. 4,027,454, discloses a sheet metal clip, which is bent into a U-shape with a bight portion connecting two leg portions. Each of the leg portions has teeth, which have been cut and sheared out along the edges of the legs for digging into a portion of a runner as the clip holds the panels on the flanges of the runner. However, these teeth only make a point contact and, thus, have not proven completely satisfactory.

Another type of clip is disclosed in U.S. Pat. No. 4,580,387. This clip is a plastic clip having a U-shape with the internal surfaces of the legs being provided with teeth or ribs, and the exterior of each of the legs of the U-shaped clip being provided with flanges for engaging or holding down the panel.

SUMMARY OF THE INVENTION

Applicant's invention is directed to providing a metal clip, which can be formed from sheet metal, which clip is easy and inexpensive to manufacture, and which clip will quickly grip the member on which it is assembled and will not twist to slip from the assembled position.

To accomplish these goals, the present invention is directed to a hold-down clip, which is formed of a one-piece metal member having a U-shaped configuration with a bight portion interconnecting two leg portions, each of the leg portions terminating in an outwardly extending foot portion for engaging and holding a panel onto a runner of a suspended ceiling system, each of the legs, along at least one edge, being provided with an inwardly directed flange having teeth formed therein for biting into the runner.

Preferably, each leg will have an inwardly directed flange along each edge so that a good gripping of either the bead of a runner or the runner itself will be obtained. Preferably, the bend of the leg relative to the bight portion is reinforced by a pair of embossments and the bend is greater than 90° so that the lowermost teeth on the edge flanges of each leg can engage a web portion of an inverted T as the clip is assembled thereon.

DESCRIPTION OF THE PREFERRED EMBODIMENTS

Figure 1:
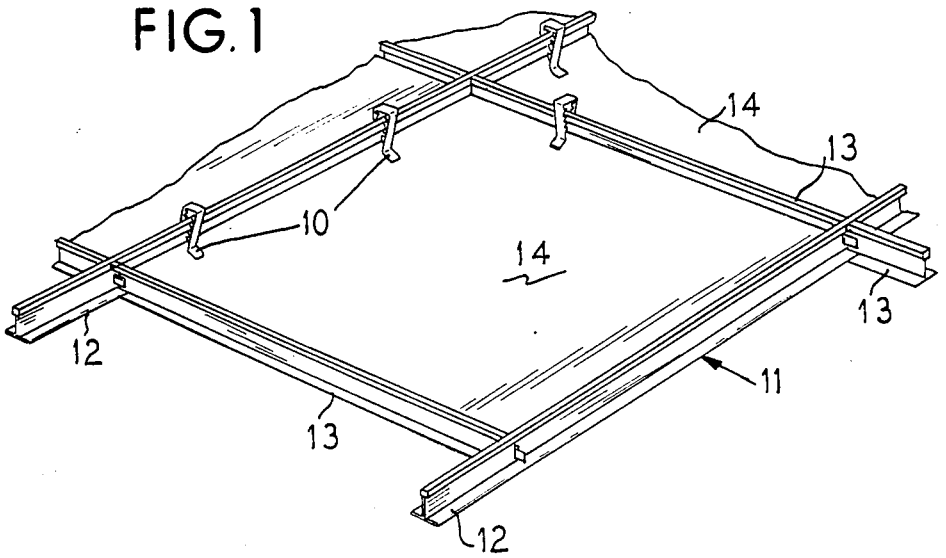
FIG. 1 is a top perspective view of a suspended ceiling system illustrating the use of the clips of the present invention.

The principles of the present invention are particularly useful in a hold-down clip, generally indicated at 10 in the Figures. The hold-down clip 10 is particularly useful in a suspended ceiling system, generally indicated at 11 in FIG. 1. The suspended ceiling system 11 is composed of a plurality of main runners 12 with cross-runners 13 which form openings. The openings, which are illustrated as being square in FIG. 1, but can be rectangular, receive panels 14. In order to hold the panels on flanges of the runners 12 and 13, the clips 10 are provided. The use of the clips is particularly desirable in those instances where the panels may be lifted off of the flanges of the main and cross-runners, due to the structure of the suspended ceiling. It should be noted that each of the runners 12 and 13 are illustrated as being inverted Ts, which have a pair of flanges 15 (see FIG. 2) extending from a web 16, which has a bead 17 opposite the flanges 15. However, the cross runners 13 could be constructed without beads, if desired.

Figure 5:
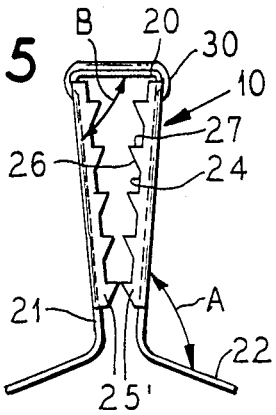
FIG. 5 is an end view of the clip while not assembled on a runner.
Figure 4:
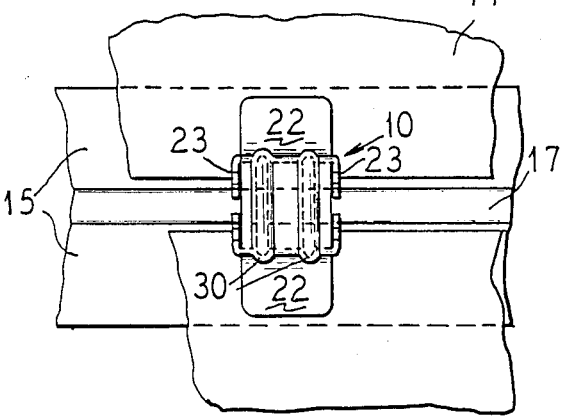
FIG. 4 is a top plan view of the clip of FIGS. 2 and 3.

Each of the clips 10 is a one-piece member, which has been bent from a piece of sheet metal, such as steel, to have a U-shaped configuration. The U-shaped configuration includes a bight portion 20, which extends between two legs 21. Each of the legs 21 terminates with a foot portion or tab 22. As best illustrated in FIGS. 4 and 5, each of the legs 21, along an edge, has an inwardly extending flange 23, which has an inward edge 24 with a plurality of teeth 25 extending therefrom. Each of the teeth 25 has a saw tooth configuration formed by a slanting edge 26 and a tooth edge 27 that merge at a point into a sharp cutting edge with a width equal to the thickness of the sheet.

Figure 3:
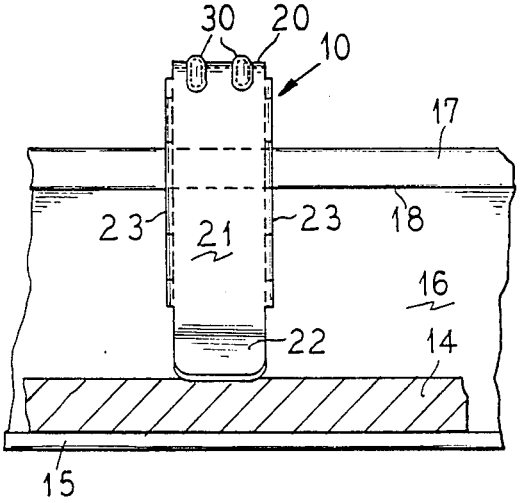
FIG. 3 is a partial side view of the clip of FIG. 2.

To increase the stiffness of the bight portion 20, it is provided with two embossments 30, which extend the width of the bight portion and have a portion that wraps around the bend forming the legs 21 (see FIGS. 3 and 5). This embossment insures that the legs are biased inward and, as illustrated, in a relaxed condition (FIG. 5), that the legs extend inward so that the points of the lower two teeth 25' on each of the legs 21 are in contact with each other or closely adjacent each other.

Figure 2:
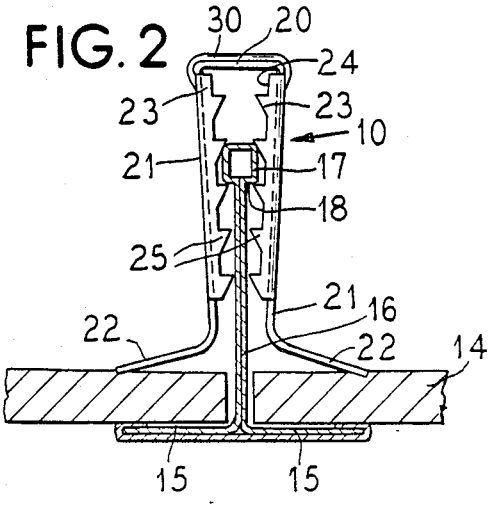
FIG. 2 is an end view illustrating the clip installed on a runner and holding panels on the flanges of the runner.

As best illustrated in FIG. 2, when the clip is inserted on the inverted T, the edges 27 of the teeth 25 will engage under a shoulder or ledge surface 18 of the bead. It is also possible, if the bead is extremely flat in width, that the cutting edges of the teeth 25 will dig into either the bead or into the web with a line contact.

When assembling the clip, it is pressed down so that the feet 22 are urged into contact with an upper surface of each of the panels 14. If desired, the clip can be pressed down to bend each of the feet or foot portions 22 and the teeth will engage the bead and hold the clip in this position so that the feet 22 resiliently urge the panel 14 against the flanges 15. As illustrated in FIG. 5, each of the feet 22 extends at an angle A with its leg 21, which is greater than 90° and is approximately 105°. Each of the legs 21 forms an angle B, with the bight portion 20, which is approximately 85° or in a range of approximately 80°–87°. Each of the teeth 25 has the edge or grasping surface 27 that forms an angle with the edge 24 of approximately 90° and, preferably, in a range of 85°–90°. The edges 26 form an angle of approximately 30°, with the edges 24 so that the edges 26 and 27 form an angle of about 60°.

Due to the provisions of the flanges 23 on each side of the legs 22, two groups of teeth will engage space portions of the carrier member and form a good contact therewith. The clip 10 will not twist as the previously known flat clips. In addition, the structure of the clip enables forming a clip out a flat sheet of metal, such as steel, with a simple punching and bending operation.

Although various minor modifications may be suggested by those versed in the art, it should be understood that I wish to embody within the scope of the patent granted hereon all such modifications as reasonably and properly come within the scope of my contribution to the art.

I claim:

1. A hold-down clip having an inverted U-shape with a bight portion interconnecting two leg portions, each of the leg portions adjacent a free end being provided with an outwardly extending foot portion, each of the leg portions, along at least one side, having an inwardly extending flange facing a flange on the other leg portion, each of said flanges terminating inward of the foot portion and outward of the bight portion to leave the bight portion free of the flange, and each of said flanges being provided with inwardly-extending teeth, which coact to grip a member on which the clip is inserted.

2. A hold-down clip according to claim 1, which further includes the bight portion having embossments to reinforce the rigidity of the bight portion and to insure resilient biasing of the leg portions towards each other.

3. A hold-down clip according to claim 2, wherein each of the leg portions has a flange with teeth on each side.

4. A hold down clip according to claim 3, wherein when in the relaxed condition, each of the legs extends toward the other leg with the teeth adjacent the free end in contact with each other.

5. A hold-down clip according to claim 1, wherein each of the legs has a flange on each side, with the flanges having teeth extending towards the teeth of the opposite leg and coacting to grip a member therebetween.

6. A hold-down clip according to claim 5, wherein the bight portion has a pair of spaced embossments extending into each of the leg portions to increase the rigidity of the bight portion.

7. A hold-down clip according to claim 6, wherein each of the foot portions extend at an angle greater than 90° to the leg.

8. A hold-down clip according to claim 7, wherein each of the legs forms an angle less than 90° with the bight portion so that the teeth furthest from the bight portion are in contact with each other when the clip is in a relaxed condition.

9. A hold-down clip according to claim 1, wherein each foot portion extends at an angle greater than 90° to its respective leg.

10. A hold-down clip for holding panels of a suspended ceiling on flanges of inverted T-members, at least some of the T-members having beads opposite the flanges, said clip having a U-shaped construction with a bight portion interconnecting two legs, each of said legs terminating at a free end in a holddown foot portion extending outwardly at an angle to the leg, each of said legs adjacent each side having an inwardly extending flange having teeth formed therein and extending towards the teeth of the adjacent leg, each of the legs forming an angle of less than 90° with the bight portion so that the teeth furthest from the bight portion are in contact with each other when the clip is in a relaxed condition and so that the clip can be inserted on an inverted T-member to grip the exposed portions of the T-member as the foot portions urge the panel against the flanges of the T-member.

11. A hold-down clip according to claim 10, wherein the foot portions extend at an angle greater than 90° to their respective leg.

12. A hold-down clip according to claim 10, wherein the bight portion has means for increasing the rigidity of the bight portion.

13. A hold-down clip according to claim 12, wherein the means for increasing the rigidity includes a pair of parallel extending embossments extending across the bight portion and terminating adjacent the upper portion of each of the legs.

14. A hold-down clip according to claim 13, wherein the teeth of one leg are aligned with the teeth of the other leg to form coacting pairs of teeth for gripping the inverted T-member when inserted thereon.

15. A hold-down clip according to claim 14, wherein the foot portions extend at an angle greater than 90° to each of their respective legs.

16. A hold-down clip according to claim 10, wherein each of the flanges having teeth terminates inward of the foot portion and outward of the bight portion.

17. A hold-down clip according to claim 16, wherein each of the teeth has a triangular configuration with one surface forming the point extending substantially at right angles to the leg.

18. A hold-down clip according to claim 10, wherein the clip is formed from a metal sheet and each of the teeth has a cutting edge with a width equal to the thickness of the sheet metal.

19. A hold-down clip for holding panels of a suspended ceiling on flanges of inverted T-members, at least some of the T-members having beads opposite the flanges, said clip being a onepiece sheet metal member having a U-shaped construction with a bight portion interconnecting two legs, which form an angle of less than 90° with the bight portion and extend toward each other, each of said legs terminating at a free end in a hold-down foot portion extending outwardly at an angle of more than 90° to the leg, each of said legs adjacent each side having an inwardly extending flange having teeth formed therein and extending towards the teeth of the adjacent leg, each of the flanges terminating inward of the foot portion and spaced from the bight portion so that each foot portion and the bight portion are free of flanges, said bight portion having means for increasing the rigidity of the bight portion comprising a pair of parallel extending embossments extending across the bight portion and into an upper portion of each leg so that the clip can be inserted on an inverted T-member to grip the exposed portions of the T-member as the foot portions resiliently urge the panel against the flanges of the T-member.

* * * * *